US010309022B2

(12) United States Patent
Awazu et al.

(10) Patent No.: US 10,309,022 B2
(45) Date of Patent: Jun. 4, 2019

(54) ELEMENT RECOVERY METHOD AND ELEMENT RECOVERY APPARATUS

(75) Inventors: Tomoyuki Awazu, Itami (JP); Takayasu Sugihara, Osaka (JP); Masatoshi Majima, Itami (JP); Toshiyuki Nohira, Kyoto (JP); Rika Hagiwara, Kyoto (JP); Seitaro Kobayashi, Kyoto (JP)

(73) Assignees: Sumitomo Electric Industries, Ltd., Osaka-shi, Osaka (JP); Kyoto University, Kyoto-shi, Kyoto (JP)

( * ) Notice: Subject to any disclaimer, the term of this patent is extended or adjusted under 35 U.S.C. 154(b) by 225 days.

(21) Appl. No.: 14/236,949

(22) PCT Filed: Aug. 8, 2012

(86) PCT No.: PCT/JP2012/070177

§ 371 (c)(1),
(2), (4) Date: Feb. 4, 2014

(87) PCT Pub. No.: WO2013/022020

PCT Pub. Date: Feb. 14, 2013

(65) Prior Publication Data

US 2014/0166501 A1 Jun. 19, 2014

(30) Foreign Application Priority Data

Aug. 10, 2011 (JP) ..... 2011-175039

(51) Int. Cl.
*C22B 59/00* (2006.01)
*C25C 3/34* (2006.01)
*C25C 7/00* (2006.01)

(52) U.S. Cl.
CPC ..... *C25C 3/34* (2013.01); *C22B 59/00* (2013.01); *C25C 7/002* (2013.01)

(58) Field of Classification Search
CPC ..... C25C 3/34; C22B 59/00
See application file for complete search history.

(56) References Cited

U.S. PATENT DOCUMENTS 3,297,554 A 1/1967 Slatin
4,790,917 A 12/1988 Dewing
(Continued)

FOREIGN PATENT DOCUMENTS

CN 1226612 A 8/1999
CN 2492563 Y 5/2002
(Continued)

OTHER PUBLICATIONS

Vanysek, P. "Electrochemical Series" in CRC Handbook of Chemistry and Physics. 91st edition (W.M. Haynes, ed.) Jun. 2010 Year: 2010).*

(Continued)

*Primary Examiner* — Steven A. Friday
(74) *Attorney, Agent, or Firm* — Drinker Biddle & Reath LLP

(57) ABSTRACT

An element recovery method and an element recovery apparatus are provided by which an element containing a high-purity rare earth element can be recovered at low cost. The element recovery method includes the steps of: preparing molten salt containing a rare earth element; and controlling electric potentials in a pair of electrode members at prescribed values while keeping the pair of electrode members in contact with the molten salt, thereby depositing the rare earth element existing in the molten salt on one of the pair of electrode members. In this way, as compared with the conventional wet separation method, an element such as a rare earth element that is to be recovered can be directly recovered from the molten salt in which the element is dissolved, so that the steps of the recovery method can be simplified and reduced in cost.

7 Claims, 9 Drawing Sheets

(56) References Cited

U.S. PATENT DOCUMENTS

| | | | | |
|---|---|---|---|---|
| 5,312,533 | A * | 5/1994 | Mayr | C02F 1/46109 204/282 |
| 5,336,378 | A | 8/1994 | Nishimura et al. | |
| 5,728,355 | A * | 3/1998 | Asada | C01F 17/0043 423/21.1 |
| 7,985,326 | B2 | 7/2011 | Withers et al. | |
| 2002/0066666 | A1* | 6/2002 | Day | C25C 7/02 204/279 |
| 2004/0151957 | A1 | 8/2004 | Brooks et al. | |
| 2010/0314260 | A1* | 12/2010 | Fujita | C25C 3/34 205/368 |
| 2011/0089045 | A1* | 4/2011 | Cardarelli | C22B 7/006 205/349 |
| 2011/0180409 | A1 | 7/2011 | Willit et al. | |
| 2012/0152062 | A1* | 6/2012 | Gourishankar | C22B 7/002 75/610 |
| 2014/0291161 | A1* | 10/2014 | Awazu | C25C 3/34 205/348 |

FOREIGN PATENT DOCUMENTS

| | | | | |
|---|---|---|---|---|
| CN | 1643184 | A | 7/2005 | |
| CN | 1962954 | A | 5/2007 | |
| CN | 101724769 | A | 6/2010 | |
| EP | 509 846 | A1 | 10/1992 | |
| GB | 933430 | A * | 8/1963 | C25C 1/22 |
| GB | 1203275 | A * | 8/1970 | C25D 3/66 |
| JP | S63-134686 | A | 6/1988 | |
| JP | H03-177594 | A | 8/1991 | |
| JP | H03-207825 | A | 9/1991 | |
| JP | H06-173064 | A | 6/1994 | |
| JP | H09-157769 | A | 6/1997 | |
| JP | H11-505801 | A | 5/1999 | |
| JP | H11-153684 | A | 6/1999 | |
| JP | 2002-060855 | A | 2/2002 | |
| JP | 2002-198104 | A | 7/2002 | |
| JP | 2003-073754 | A | 3/2003 | |
| JP | 2005-011698 | A | 1/2005 | |
| JP | 2005-113191 | A | 4/2005 | |
| JP | 2005-264209 | A | 9/2005 | |
| JP | 2008-202064 | A | 9/2008 | |
| JP | 2009-287119 | A | 12/2009 | |
| JP | 2011-094227 | A | 5/2011 | |
| JP | 2011-122242 | A | 6/2011 | |
| WO | WO-02/066712 | A1 | 8/2002 | |
| WO | WO-2005/111272 | A1 | 11/2005 | |

OTHER PUBLICATIONS

Toshiyuki Nohira et al., "Formation of Rare Earth Alloys by Molten Salt Electrochemical Process", Department of Fundamental Energy Science, Graduate School of Energy Science, Kyoto University, Feb. 20, 2004, vol. 47, No. 1, pp. 5-12.

Yand, "Studies on Electrodeposition of Rare Earth Metals and Their Alloys in Molten Salts," Electrochemistry, vol. 3, No. 2, May 25, 1997, pp. 117-124, with attached English-language abstract.

Notice of Grounds of Rejection dated Apr. 26, 2016 in Japanese Patent Application No. 2013-528046 (2 pages) with an English translation (4 pages).

"Compilation of Nobel Metals and Rare Metal Recycling Techniques," published by NTS Inc., Planned and edited by Bookers Ltd., the first impression of the first edition, Oct. 19, 2007, including partial English translation.

Rare-Metal High-Efficiency-Recovery-System Development Project, "Recovery of tungsten etc. from waste cemented carbide tools," Metal Resource Report, Nov. 2008, pp. 407-413, vol. 38, No. 4, including partial English translation.

Courses of Contemporary Metallurgy, Smelting Part, vol. 2, "Nonferrous Metal Smelting," edited by the Japan Institute of Metals and Materials, 1980, pp. 46, 194, 199, 219 and 254, including partial English translation.

Notification of Reasons for Refusal dated Feb. 24, 2016 is Japanese Patent Application No. 2012-149288 (4 pages) with a partial English Translation (2 pages).

Notification of Second Office Action dated Apr. 29, 2016 in Chinese Patent Application No. 2012800541321 (7 pages) with an English Translation (9 pages).

Article J 78-296 in "Metallurgical Patent Liturature," Institute of Scientific and Technical Information of Shanghai, Shanghai Scientific & Technical Publishers, 1980, p. 241, with a partial English translation.

Notification of the First Office Action dated Oct. 8, 2015 in Chinese Patent Application No. 2012800541321 (9 pages) with an English Translation (11 pages).

Examiner's Decision of Refusal dated Sep. 16, 2016 in Japanese Patent Application No. 2012-149053 (5 pages) with an English Translation (5 pages).

Examiner's Decision of Refusal dated Sep. 16, 2016 in Japanese Patent Application No. 2012-049288 (5 pages) with an English Translation (5 pages).

Examiner's Decision of Refusal dated Sep. 16, 2016 in Japanese Patent Application No. 2012-149288 (5 pages) with an English Translation (5 pages).

Notification of Opposition dated Apr. 5, 2017 in Japanese Opposition No. 2017-700244 (25 pages) with a partial English translation (15 pages).

Demandant's Exhibit No. 3—Certificate of library material in the possession of the National Diet Library with an English translation of the relevant portions, dated Jan. 25, 2017.

Demandant's Exhibit No. 1—Konishi et al., "Selective Separation of Rare Earth Metals by Molten Salt Electrolysis and Alloy Diaphragm," Molten Salts, vol. 54, No. 1, pp. 21-28, 2011 (9 pages), with an English translation of the relevent portions (7 pages).

* cited by examiner

ELEMENT RECOVERY METHOD AND ELEMENT RECOVERY APPARATUS

TECHNICAL FIELD

The present invention relates to an element recovery method and an element recovery apparatus, and more particularly to an element recovery method and an element recovery apparatus by which an element containing a rare earth element can be recovered.

BACKGROUND ART

Conventionally, there has been a proposed method of recovering a useful element such as a rare earth element from scraps of an iron-based alloy material. For example, Japanese Patent Laying-Open No. 03-207825 (which will be hereinafter referred to as PTD 1) discloses a method of separating and recovering a rare earth element by dissolving rare-earth magnet scraps in a nitric acid-sulfuric acid aqueous solution, adding alcohol into the resultant solution and selectively crystallizing sulfate of the rare earth element. Furthermore, Japanese Patent Laying-Open No. 09-157769 (which will be hereinafter referred to as PTD 2) discloses a method of recovering a rare earth element by hydrotreating and pulverizing alloy scraps containing a rare earth element, overheating the pulverized scraps to achieve an oxide, which is then brought into contact with an acid solution, to elute the rare earth element as ions into the acid solution and produce a deposit containing the rare earth element from this ion-containing acid solution.

Furthermore, Japanese Patent Laying-Open No. 2002-60855 (which will be hereinafter referred to as PTD 3) discloses a method of recycling neodymium (Nd)-based rare-earth magnet scraps by introducing the scraps into a molten-salt electrolytic bath including rare earth oxides as raw materials, melting the scraps in the electrolytic bath, separating the scraps into a rare earth oxide and a magnet alloy portion, reducing the rare earth oxide dissolved in the electrolytic bath to a rare earth metal by electrolysis, and alloying the magnet alloy portion and the rare earth metal, thereby reproducing the scraps as a rare earth metal. Furthermore, Japanese Patent Laying-Open No. 2002-198104 (which will be hereinafter referred to as PTD 4) discloses a method of recycling a hydrogen absorbing alloy, by which a hydrogen absorbing alloy is immersed as an anode in molten salt together with a cathode, in which state a voltage is applied between the cathode and the anode, to dissolve a rare earth element from the anode into the molten salt, thereby depositing a rare earth element on the surface of the cathode from the molten salt by an electrolytic reduction reaction, and recovering the rare earth element.

Furthermore, Japanese Patent Laying-Open No. 2003-73754 (which will be hereinafter referred to as PTD 5) discloses a method of recovering a rare earth element, by which a substance containing a rare earth element and an iron group element (for example, scraps of a rare-earth magnet and the like) into contact with iron chloride in a gaseous state or a molten state, causing a chloride reaction of the rare earth element in the substance to progress while keeping the iron group element in the substance in a metal state, and selectively recovering the rare earth element as chloride from the substance. Furthermore, Japanese Patent Laying-Open No. 2005-264209 (which will be hereinafter referred to as PTD 6) discloses a method of recovering a rare earth element through electrophoresis conducted in the state where the rare earth element is dissolved in molten salt having a prescribed composition. Furthermore, Japanese Patent Laying-Open No. 2009-287119 (which will be hereinafter referred to as PTD 7) discloses a method of recovering a rare earth element, by which a bipolar electrode-type diaphragm is disposed between a cathode and an anode during molten salt electrolysis to form a cathode chamber and an anode chamber, and a voltage is applied between the cathode and the anode while supplying rare earth element ions toward the anode chamber, to cause the rare earth element to diffuse and transmit through the diaphragm, thereby depositing the rare earth element on the surface of the cathode.

CITATION LIST

Patent Document

PTD 1: Japanese Patent Laying-Open No. 3-207825
PTD 2: Japanese Patent Laying-Open No. 9-157769
PTD 3: Japanese Patent Laying-Open No. 2002-60855
PTD 4: Japanese Patent Laying-Open No. 2002-198104
PTD 5: Japanese Patent Laying-Open No. 2003-73754
PTD 6: Japanese Patent Laying-Open No. 2005-264209
PTD 7: Japanese Patent Laying-Open No. 2009-287119

SUMMARY OF INVENTION

Technical Problem

Among the conventional recovery methods as described above, for example, the methods disclosed in PTD 1 and PTD 2 each pose a problem that the number of process steps are increased and the equipment cost is raised, with the result that a large quantity of wastewater is produced, and iron contained in the scrap turns into hydroxide or oxide of low utility value, which requires a special process. Furthermore, the method using molten salt disclosed in each of PTD 3 to PTD7 also poses a problem that the purity of the recovered rare earth element is relatively low (for example, separation from a transition metal is insufficient), the processing speed is limited, or a large-voltage power supply is required for causing electrophoresis in the molten salt, which results in excessively increased equipment cost or processing cost.

The present invention has been made to solve the above-described problems, and an object of the present invention is to provide an element recovery method and an element recovery apparatus by which an element containing a high-purity rare earth element can be recovered at low cost.

Solution to Problem

An element recovery method according to the present invention includes the steps of: preparing molten salt containing a rare earth element; and depositing the rare earth element. The step of depositing the rare earth element is implemented by controlling electric potentials in a pair of electrode members (which will be hereinafter also referred to as electrodes) at prescribed values while keeping the pair of electrode members in contact with the molten salt, to deposit the rare earth element existing in the molten salt on one of the pair of electrode members.

In this way, by controlling the values of the electric potentials, the element containing a rare earth element can be selectively deposited from the molten salt on one of the electrode members. Accordingly, as compared with the case where processes such as dissolution and extraction using acid and the like are repeated as in the conventional wet processing, the recover step can be simplified, and also, a specific element can be selectively separated and recovered. Therefore, the recovery step can be improved in efficiency and reduced in cost.

An element recovery method according to the present invention includes the steps of: preparing an object to be processed that is conductive and contains a rare earth element; and controlling electric potentials in the object to be processed and an electrode member at prescribed values while keeping the object to be processed and the electrode member in contact with molten salt, to elute an element containing the rare earth element in accordance with the electric potentials from the object to be processed into the molten salt.

In this way, by controlling the values of the electric potentials, the element containing a rare earth element can be selectively eluted from the object to be processed in the molten salt. Accordingly, as compared with the case where processes such as dissolution and extraction using acid and the like are repeated as in the conventional wet processing, the recovery step can be simplified, and also, a specific element can be selectively separated and recovered. Therefore, the recovery step can be improved in efficiency and reduced in cost.

An element recovery method according to the present invention includes the steps of: preparing an object to be processed that is conductive and contains a rare earth element; and controlling electric potentials in the object to be processed and an electrode member at prescribed values while keeping the object to be processed and the electrode member in contact with molten salt, to elute an element containing the rare earth element in accordance with values of the electric potentials from the object to be processed into the molten salt, and deposit the element on the electrode member.

In this way, the element contained in the object to be processed is deposited on the surface of the electrode member, so that the element can readily be recovered.

An element recovery apparatus according to the present invention includes a container containing molten salt; an electrode for recovery, a holding electrode, and a control unit. The electrode for recovery is immersed in the molten salt contained in the container. The holding electrode is immersed in the molten salt contained in the container, and an object to be processed that is conductive and contains a rare earth element is held in the holding electrode. The molten salt can circulate between inside and outside of the holding electrode. The control unit controls electric potentials in the electrode for recovery and the holding electrode. The control unit is capable of changing the electric potentials. Furthermore, the control unit may be able to control a plurality of values of the electric potentials for the electrode for recovery and the holding electrode in prescribed order for a prescribed time period.

In this case, by setting the electric potentials at values such that rare earth elements are eluted from the object to be processed held in the holding electrode into the molten salt and the rare earth elements deposit on the surface of the electrode for recovery, the rare earth elements can be selectively recovered for each element. Furthermore, the electrode for recovery may include a plurality of electrode members connected to the control unit and controlled by this control unit so as to be set at electric potentials in accordance with the types of the rare earth elements. In this case, by sequentially changing electric potentials of the plurality of electrode members to prescribed values, a different element (a rare earth element) can be deposited on the surface of each electrode member, and thereby recovered.

Advantageous Effects of Invention

According to the present invention, the electrode can be controlled so as to be set at the electric potential in accordance with the deposition potential of the element to be recovered. Accordingly, a rare earth element can be selectively deposited on the surface of the electrode from the molten salt containing the rare earth element, with the result that the configurations of the element recovery method and the element recovery apparatus can be simplified. Therefore, the cost and time required for element recovery can be reduced while the purity of the element to be recovered can be enhanced.

DESCRIPTION OF EMBODIMENTS

Figure 1:
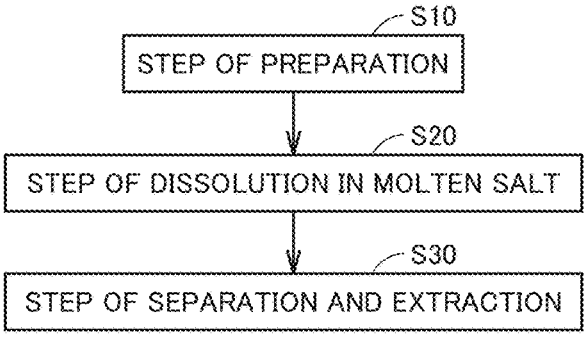
FIG. 1 is a flowchart for illustrating an embodiment of an element recovery method according to the present invention.

The embodiments of the present invention will be hereinafter described with reference to the accompanying drawings, in which the same or corresponding components are designated by the same reference characters, and description thereof will not be repeated.

Referring to FIG. 1, an element recovery method according to the present invention will be described. First, as shown in FIG. 1, a preparing step (S10) is carried out. In this case, a recovery apparatus or the like is prepared that includes an object to be processed from which a rare earth element is recovered, molten salt used in this recovery method, a container containing the molten salt or an electrode, and the like. In order to accelerate dissolution of the object to be processed into the molten salt, the object to be processed can also be pulverized for the purpose of increasing the area of contact between the object to be processed and the molten salt.

Then, a process of dissolution into molten salt (S20) is carried out. In this step (S20), the object to be processed and (another) electrode member are immersed in the prepared molten salt, and a control unit is connected to the object to be processed and the electrode member, thereby controlling the values of electric potentials. Then, the electric potential of the object to be processed is adjusted, to cause the rare earth element contained in the object to be processed to be selectively dissolved in the molten salt. As to molten salt, while molten salt having any composition can be used, for example, molten salt having a composition such as KCl—$CaCl_2$, LiCl—KCl or NaCl—KCl can be used. By way of example, KCl—$CaCl_2$ can be used as molten salt, an electrode made of glassy carbon can be used as another electrode member, and a magnet containing a rare earth element can be used as an object to be processed. In this case, for example, by setting the temperature for heating the molten salt at 700° C. and setting the above-mentioned electric potential (electric potential of the object to be processed) at 1.8V (vs. $Ca^{2+}$/Ca), a rare earth element (for example, neodymium (Nd), dysprosium (Dy), praseodymium (Pr), and the like) can be selectively eluted into the molten salt from the magnet containing the rare earth element. The above-described electric potentials are set at values such that iron is hardly dissolved in the molten salt but a rare earth element is dissolved.

Figure 2:
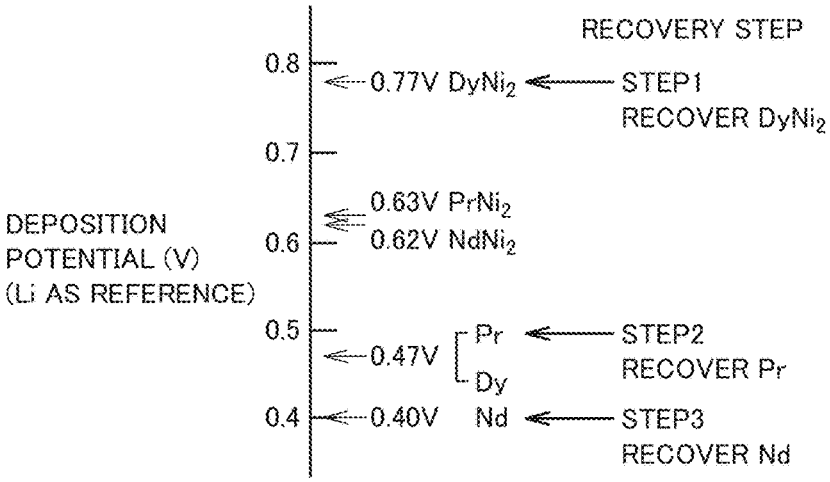
FIG. 2 is a schematic diagram showing examples of deposition potentials of rare earth elements in molten salt.

Then, as shown in FIG. 1, a separation and extraction step (S30) is carried out. Specifically, a pair of electrodes are inserted into the molten salt in which a rare earth element is eluted as described above, and a cathode of these electrodes is controlled to be set at a value of a prescribed electric potential. For example, when LiCl—KCl-based molten salt is used, this value of the electric potential is controlled at an electric potential corresponding to the deposition potential determined for each rare earth element as shown in FIG. 2. Consequently, the type of the rare earth element to be deposited on the cathode can be selected in accordance with the controlled electric potential. Therefore, the rare earth elements can be selectively recovered for each type of the elements.

For example, as shown in FIG. 2, rare earth elements such as neodymium (Nd), dysprosium (Dy) and praseodymium (Pr) are different in deposition potential value for each type of the elements. Specifically, as shown in FIG. 2, the deposition potential of Nd is about 0.40V (vs. $Li^+$/Li), the deposition potential of each of Pr and Dy is about 0.47V (vs. $Li^+$/Li), and the deposition potential of $DyNi_2$ that is a compound of Dy is about 0.77V (vs. $Li^+$/Li). For the deposition potential shown in FIG. 2, Li is used as a reference. Furthermore, the vertical axis in FIG. 2 shows a deposition potential (unit: V). The deposition potential shows a value in the case that LiCl—KCl is used as molten salt and the temperature of the molten salt is set at 450° C.

In this way, the deposition potentials of elements or compounds are different. Accordingly, a pair of electrodes is immersed in the molten salt in which rare earth elements are melted in advance, and the electric potential of the cathode is controlled so as to be set at a value of the electric potential corresponding to the above-described deposition potential, thereby allowing a specific rare earth element to be selectively deposited on the cathode. Then, by changing the value of the electric potential in the cathode (for example, sequentially changing the electric potentials), the type of the rare earth element to be deposited can also be selected.

Figure 3:
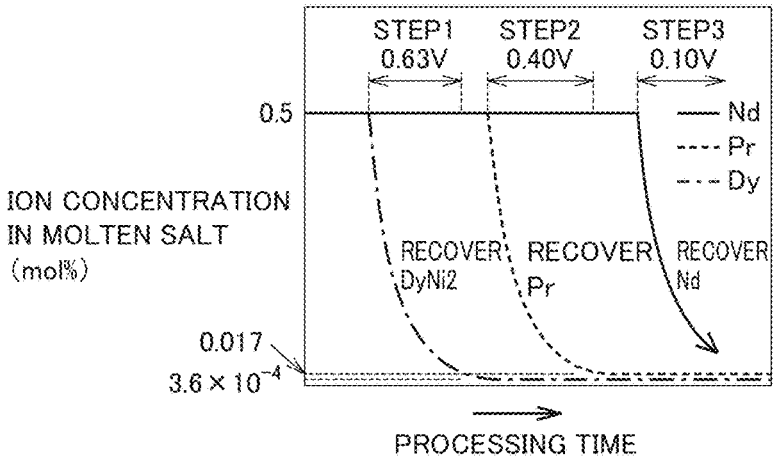
FIG. 3 is a graph showing an example of the relation between the processing time and the ion concentration of each rare earth element in the molten salt in the case that the element recovery method according to the present invention is carried out.

For example, as shown in FIG. 3, one pair of electrodes are immersed in the molten salt in which the above-described Nd, Dy and Pr are dissolved, and the cathode is controlled to be sequentially set at different electric potentials. It is to be noted that concentrations (ion concentrations) of Nd, Dy and Pr in the molten salt each are set at 0.5 mol %. When the data shown in FIG. 2 is used as values of deposition potentials, for example, LiCl—KCl is used as molten salt and the temperature of the molten salt is set at 450° C. In FIG. 3, the horizontal axis shows processing time while the vertical axis shows the ion concentration of each rare earth element in the molten salt. The unit of the vertical axis is mol %.

First, in STEP 1, when nickel (Ni) is used for a cathode material and the electric potential of the cathode is set at a value lower than 0.77V (vs. $Li^+$/Li) and slightly higher than 0.63 V (vs. $Li^+$/Li) (for example, when the setting electric potential is 0.631 V (vs. $Li^+$/Li)), Dy ions are alloyed with Ni of the cathode material, to thereby cause $DyNi_2$ to deposit on the surface of the cathode. Consequently, as shown in FIG. 3, the ion concentration of Dy in the molten salt is to suddenly fall. Recovery of Dy can be carried out until the Dy ion concentration in the molten salt becomes approximately equal to $3.6\times10^{-4}$ mol %.

Then, in STEP 2, when the electric potential of another electrode (for example, an Mo electrode) is set at a value slightly higher than 0.40V (vs. $Li^+$/Li) (for example, when the setting electric potential is set at 0.401V (vs. $Li^+$/Li)), Pr deposits on one of the electrodes (cathode). Consequently, as shown in FIG. 3, the Pr ion concentration in the molten salt is to suddenly fall. Recovery of Pr can be carried out until the Pr ion concentration in the molten salt becomes approximately equal to 0.017 mol %. It is to be noted that an electrode used in STEP 2 is different from the electrode on which $DyNi_2$ deposits in STEP 1. For example, the electrode on which $DyNi_2$ deposits in STEP 1 may be removed from the molten salt before STEP 2 is started, and another electrode may be immersed in the molten salt, or the electrode on which $DyNi_2$ deposits is remained as it is, and the electric potential of another electrode may be controlled in STEP 2.

Then, in STEP 3, when the electric potential of another electrode (for example, an Mo electrode) is set at 0.10V (vs.

$Li^+/Li$), Nd deposits on this electrode (cathode). Consequently, as shown in FIG. 3, the Nd ion concentration in the molten salt is to suddenly fall. Recovery of Nd can be carried out until the Nd ion concentration in the molten salt becomes approximately equal to $2.7\times10^{-7}$ mol %, for example. In addition, the electrode on which Pr deposited in STEP 2 may be removed from the molten salt before STEP 3 is started, and another electrode may be immersed in the molten salt. Alternatively, the electrode on which Pr deposited in STEP 2 may be remained immersed in the molten salt, and another electrode may be used in STEP 3.

Then, as to $DyNi_2$ recovered in STEP 1, in STEP 4, the electrode having a surface on which $DyNi_2$ deposits is immersed in the molten salt together with another electrode (for example, an Mo electrode), and then, the electric potential of the $DyNi_2$ electrode is set in the range of an electric potential in which Dy is dissolved but Ni is not dissolved (equal to or higher than 0.77 and equal to or lower than 2.6V (vs. $Li^+/Li$)). Thereby, Dy can be dissolved in the molten salt while only Dy can be deposited on the surface of another electrode.

In this way, rare earth elements can be recovered from the molten salt for each type of elements. Then, referring to FIGS. 4 and 5, the element recovery apparatus used in the element recovery method according to the present invention shown in FIG. 1 will be hereinafter described. The recovery apparatus shown in FIG. 4 includes a container 1 containing molten salt; molten salt 2 contained in container 1; a basket 4 holding an object to be processed 3 therein; electrodes 6 to 8; a heater 10 for heating molten salt 2; and a control unit 9 electrically connected to basket 4 and electrodes 6 to 8 through a conductive wire 5. Assuming that basket 4 is used as one electrode while one of electrodes 6 to 8 is used as the other electrode, control unit 9 can control the electric potentials of these electrodes. Furthermore, control unit 9 can change the values of the electric potentials to be controlled. Heater 10 is arranged so as to surround container 1 in a circular pattern. Although electrodes 6 to 8 can be formed by any material, electrode 6 may be made, for example, of nickel (Ni); and electrodes 7 and 8 may be made, for example, of carbon (C). It is to be noted that container 1 may have a circular-shaped or polygonal-shaped bottom surface.

Furthermore, basket 4 may be made of any material as long as it is a conductive material. The upper portion of basket 4 has an opening, through which object to be processed 3 such as a rare-earth magnet can be insert into basket 4. Basket 4 has a side wall and a bottom wall each provided with a number of holes, through which molten salt 2 can flow into basket 4. Basket 4 may be made of any material such as a mesh-like member formed by weaving metal wires, and a sheet member formed by a sheet-like metal plate provided with a number of holes. It is particularly effective to use C, Pt, Mo and the like as the material mentioned above.

The electric potentials in basket 4 and electrodes 6 to 8 are controlled by control unit 9 so as to be set at prescribed values. By controlling electrodes 6 to 8 so as to have different electric potentials, different rare earth elements deposit on the surfaces of electrodes 6 to 8 in accordance with the values of the electric potentials, as will be described later. For example, the electric potential in electrode 6 can be adjusted such that a $DyNi_2$ film 11 deposits on the surface of electrode 6, as will be describe later. Furthermore, by adjusting the electric potential in electrode 7, a Pr film 12 can be deposited on the surface of electrode 7. Furthermore, by adjusting the electric potential in electrode 8, an Nd film 13 can be deposited on the surface of electrode 8.

Figure 4:
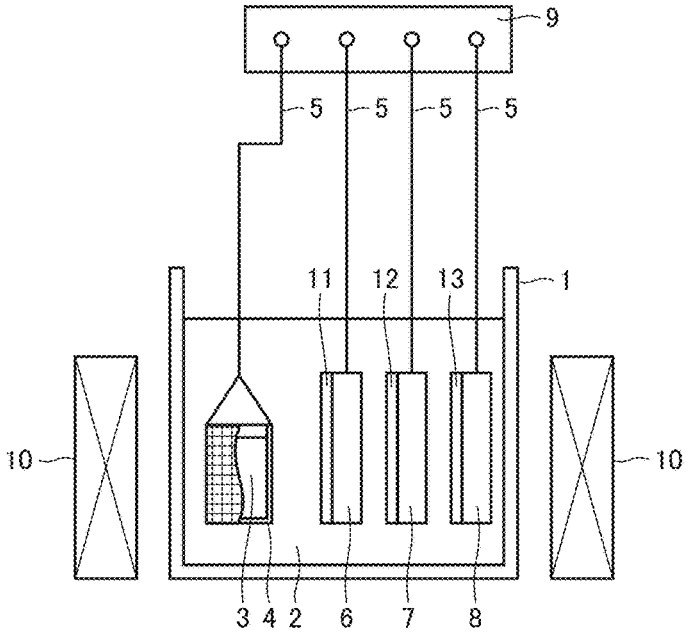
FIG. 4 is a schematic cross-sectional view for illustrating the configuration of an element recovery apparatus by which the element recovery method according to the present invention is carried out.
Figure 5:
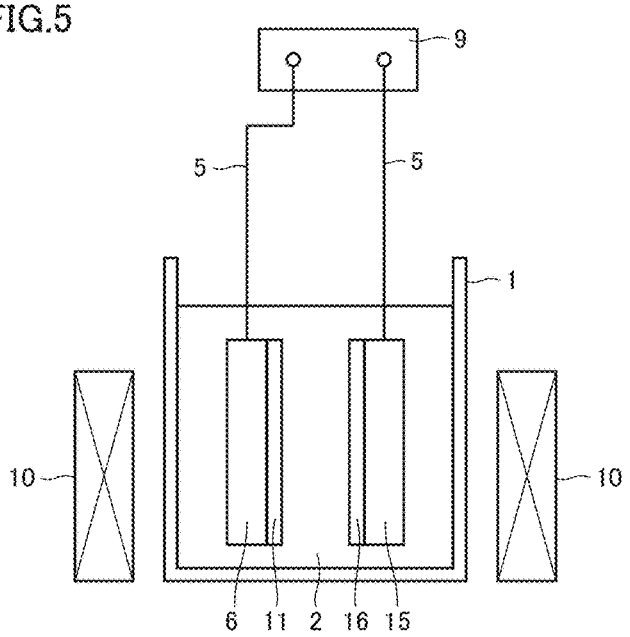
FIG. 5 is a schematic cross-sectional view for illustrating the configuration of the element recovery apparatus by which the element recovery method according to the present invention is carried out.

Then, electrode 6 on which $DyNi_2$ film 11 deposits is arranged within container 1 containing molten salt 2, as shown in FIG. 5. Furthermore, the other electrode is arranged in molten salt 2 so as to face electrode 6 having a surface on which $DyNi_2$ film 11 deposits, and these electrodes 6 and 15 are connected to control unit 9 via conductive wire 5. Then, the electric potentials in electrodes 6 and 15 are controlled by control unit 9 while heating molten salt 2 by heater 10 disposed around container 1. The values of the electric potentials to be controlled at this time are adjusted such that the electric potentials in electrodes 6 and 15 each are equal to a deposition potential of Dy. Consequently, Dy is to melt into molten salt 2 from $DyNi_2$ film 11 that deposited on the surface of electrode 6 while Dy film 16 is to deposit on the surface of electrode 15. In addition, the temperature for heating molten salt 2 by heater 10 can be set, for example, at 800° C. for any process in the apparatus shown in FIGS. 4 and 5. In this way, it becomes possible to cause a rare earth element to deposit as a simple substance on the surface of each of electrodes 7, 8 and 15.

It is considered that a specific element recovery method for recovering a rare earth element using the element recovery apparatus as shown in FIG. 4 FIG. 5 is implemented, for example, as described below. For example, 9 Kg of a magnet containing a rare earth element as object to be processed 3 is prepared and KCl—NaCl is prepared as molten salt 2. The magnet is assumed to contain Nd of 20 wt %, Pr of 6 wt % and Dy of 5 wt %. The magnet is pulverized and placed within basket 4. For the purpose of improving the process efficiency, it is preferable to pulverize the magnet used as object to be processed 3 as small as possible. For example, the magnet is pulverized in a granular manner such that the maximum value of the diameter is 5 mm or less, more preferably 3 mm or less, and further more preferably 1 mm or less. The amount of molten salt 2 is set at about 16 liters (mass: 25 kg).

Then, object to be processed 3 held in basket 4 and one of electrodes 6 to 8 are employed as a pair of electrodes, to perform STEP 1 to STEP 3 of the element recovery method described with reference to FIGS. 2 and 3. Specifically, as STEP 1 described above, object to be processed 3 held in basket 4 and electrode 6 are employed as a pair of electrodes, and the electric potentials in these electrodes are controlled to be set at prescribed values. Consequently, $DyNi_2$ deposits on the surface of electrode 6. Furthermore, as STEP 2 described above, object to be processed 3 held in basket 4 and electrode 7 are employed as a pair of electrodes, and the electric potentials of these electrodes are controlled to be set at prescribed values. Consequently, Pr deposits on the surface of electrode 7. The mass of the Pr film that deposits on the surface of electrode 7 shown in FIG. 4 is approximately 500 g to 600 g, for example.

Furthermore, as STEP 3 described above, object to be processed 3 held in basket 4 and electrode 8 are employed as a pair of electrodes, and the electric potentials of these electrodes are controlled to be set at prescribed values. Consequently, Nd deposits on the surface of electrode 8. The mass of the Nd film that deposits on the surface of electrode 8 is approximately 1500 g to 2000 g, for example.

Furthermore, as STEP 4 described above, the above-mentioned electrode 6 and electrode 15 are arranged in the recovery apparatus shown in FIG. 5, and the electric potentials of these electrodes are controlled to be set at prescribed values in the molten salt. Consequently, Dy deposits on the surface of electrode 15. The mass of Dy film 16 that deposits on the surface of electrode 15 is approximately 400 g to 500 g, for example. As having been described with reference to FIG. 4, the step of dissolving a rare earth element and the like in molten salt 2 and the step of depositing a rare earth element as a simple substance on the surface of each of electrodes 7 and 8 and the like are carried out in the same apparatus (using the same molten salt 2). On the other hand, it is preferable that the step of separating and extracting Dy from $DyNi_2$ as described in STEP 4 is carried out in an apparatus (an apparatus shown in FIG. 5) different from the apparatus (an apparatus shown in FIG. 4) used in the step of dissolving a rare earth element and the like in molten salt 2, as described with reference to FIG. 4.

In this way, Dy, Pr and Nd that are rare earth elements can be recovered from the magnet as object to be processed 3.

Then, another embodiment of the element recovery method according to the present invention will be hereinafter described with reference to FIGS. 6 to 13. In the following description, a magnet disposed of as an object to be processed (a waste magnet containing a rare earth element) is used as in the above description.

Figure 6:
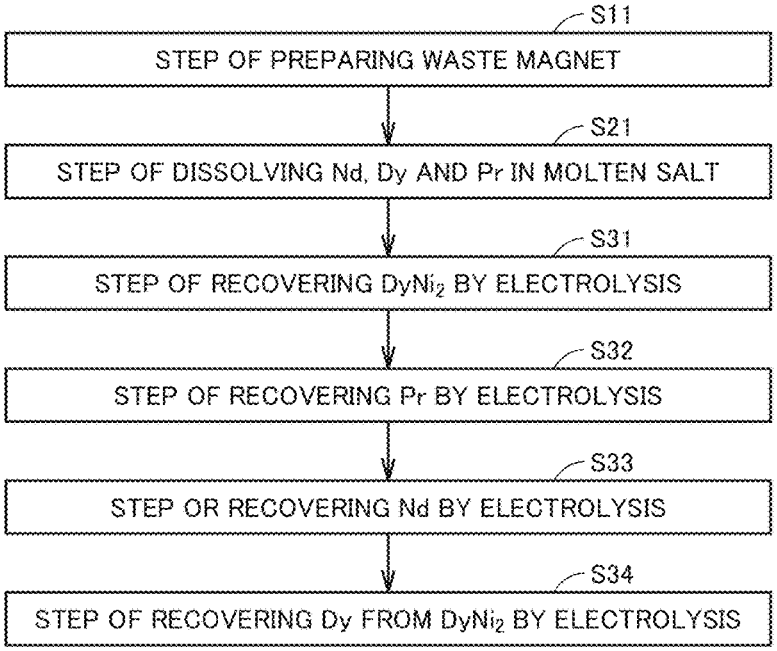
FIG. 6 is a flowchart for illustrating another embodiment of the element recovery method according to the present invention.
Figure 7:
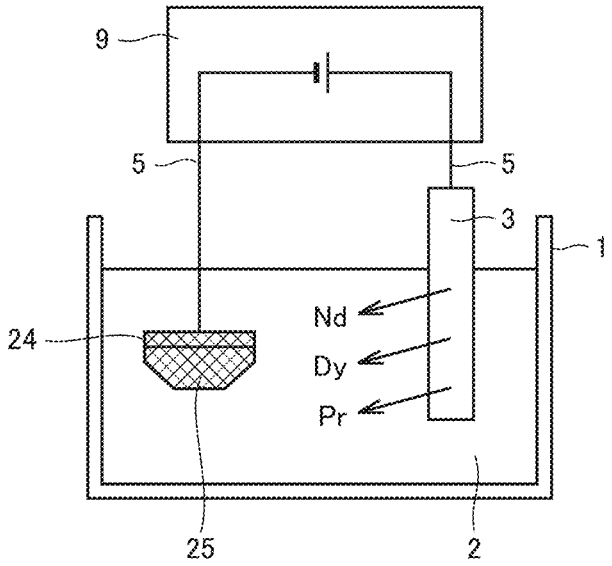
FIG. 7 is a schematic cross-sectional view for illustrating another embodiment of the element recovery method according to the present invention.

As shown in FIG. 6, the step (S11) of preparing a waste magnet as an object to be processed is first performed. Specifically, as shown in FIG. 7, a waste magnet as object to be processed 3 is immersed in molten salt 2 contained in container 1, and conductive wire 5 is connected to this object to be processed 3 so as to be connected to a power supply in control unit 9.

Then, electrode material 25 held within basket 24 as the other electrode is immersed in molten salt 2 while this electrode material 25 is being held within basket 24. As this electrode material 25, a material that can be readily alloyed with an alkali metal such as Li and Na forming a positive ion in the molten salt is used. Examples of this electrode material 25 may be aluminum (Al), zinc (Zn), gallium (Ga), cadmium (Cd), indium (In), tin (Sn), antimony (Sb), lead (Pb), bismuth (Bi), and the like.

Then, the step (S21) of dissolving Nd, Dy and Pr in the molten salt as shown in FIG. 6 is carried out. Specifically, as shown in FIG. 7, control unit 9 controls the electric potentials in object to be processed 3 and electrode material 25 held in basket 24, thereby adjusting these electric potentials in electrode material 25 and object to be processed 3 at prescribed values. Consequently, rare earth elements such as Nd, Dy and Pr dissolve into molten salt 2 from the magnet as object to be processed 3.

Figure 8:
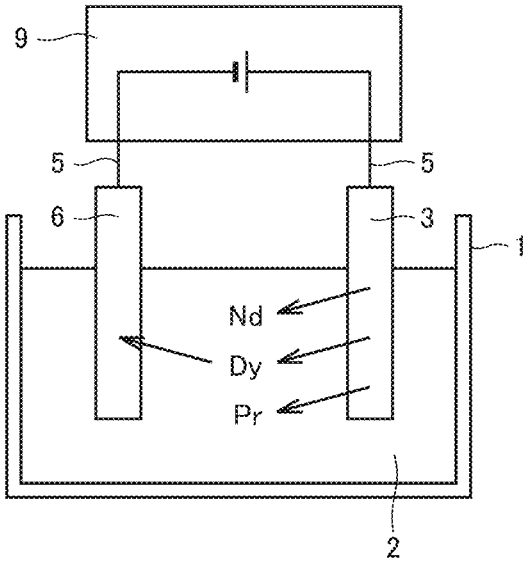
FIG. 8 is a schematic cross-sectional view for illustrating another embodiment of the element recovery method according to the present invention.

Then, the step (S31) of recovering $DyNi_2$ by electrolysis as shown in FIG. 6 is carried out. Specifically, in replace of electrode material 25 held in basket 24 shown in FIG. 7, electrode 6 made of nickel is immersed in molten salt 2, as shown in FIG. 8. Then, this electrode 6 is connected to control unit 9 via conductive wire 5. In this state, control unit 9 controls the electric potentials in object to be processed 3 as one electrode and electrode 6 as the other electrode, thereby adjusting these electric potentials at prescribed values. Consequently, a rare earth element such as Dy is eluted from object to be processed 3 into molten salt 2 while $DyNi_2$ deposits on the surface of electrode 6 from molten salt 2.

Figure 9:
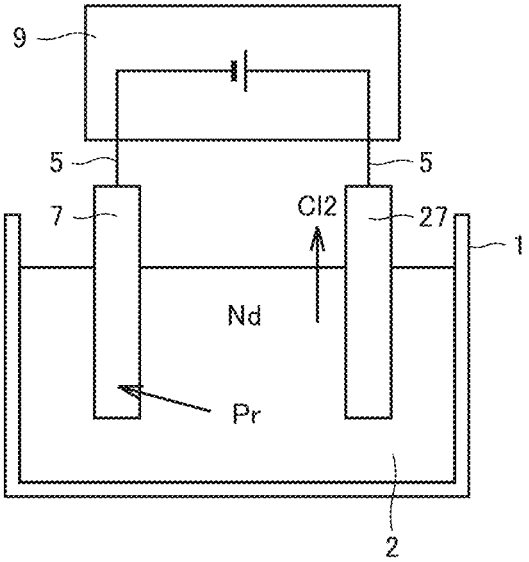
FIG. 9 is a schematic cross-sectional view for illustrating another embodiment of the element recovery method according to the present invention.

Then, the step (S32) of recovering Pr by electrolysis as shown in FIG. 6 is carried out. Specifically, as shown in FIG. 9, in place of object to be processed 3, electrode 27 made of carbon is immersed as one electrode in molten salt 2. Furthermore, in place of electrode 6 shown in FIG. 8, electrode 7 made of carbon is arranged so as to be immersed in molten salt 2 such that electrode 7 is located to face electrode 27. Then, electrode 27 and electrode 7 are electrically connected to control unit 9 through conductive wire 5. In this state, the electric potentials in one electrode 27 and the other electrode 7 are controlled to be adjusted at prescribed values. Consequently, Pr dissolved in molten salt 2 deposits on the surface of electrode 7. In addition, when chloride is used as molten salt 2 in this case, chlorine gas ($Cl_2$) is generated from electrode 27.

Figure 10:
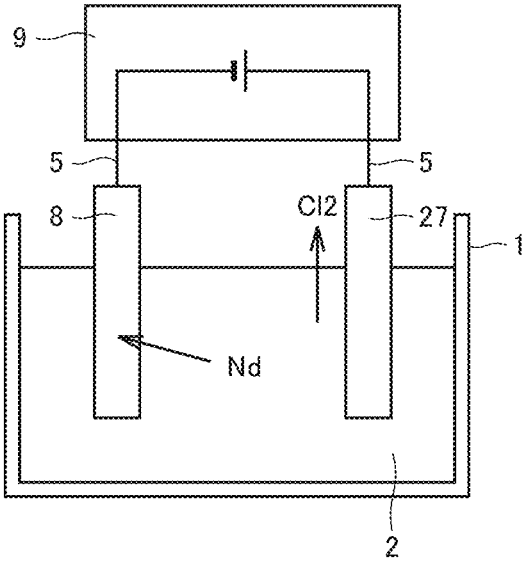
FIG. 10 is a schematic cross-sectional view for illustrating another embodiment of the element recovery method according to the present invention.

Then, the step (S33) of recovering Nd by electrolysis as shown in FIG. 6 is carried out. Specifically, in place of electrode 7 as described above, electrode 8 made of carbon is arranged so as to be immersed in molten salt 2 such that electrode 8 faces electrode 27, as shown in FIG. 10. This electrode 8 is electrically connected to control unit 9 through conductive wire 5. Then, control unit 9 controls the electric potentials in electrode 8 and electrode 27 so as to be adjusted at prescribed values. Consequently, Nd deposits on the surface of electrode 8. Also in this case, chlorine gas is generated from electrode 27.

Then, the step (S34) of recovering Dy by electrolysis from $DyNi_2$ recovered in the above step (S31) is carried out. Specifically, as shown in FIG. 5, electrode 6 (see FIG. 8) having a surface on which $DyNi_2$ deposits is immersed in molten salt 2, another electrode 15 is arranged so as to be immersed in molten salt 2, and the electric potentials in these electrodes 6 and 15 are controlled by control unit 9 so as to be set at prescribed values. Consequently, once $DyNi_2$ deposited on the surface of electrode 6 dissolves in molten salt 2, Dy film 16 deposits on the surface of electrode 15. In this way, Nd, Dy and Pr that are rare earth elements can be separately recovered.

Figure 11:
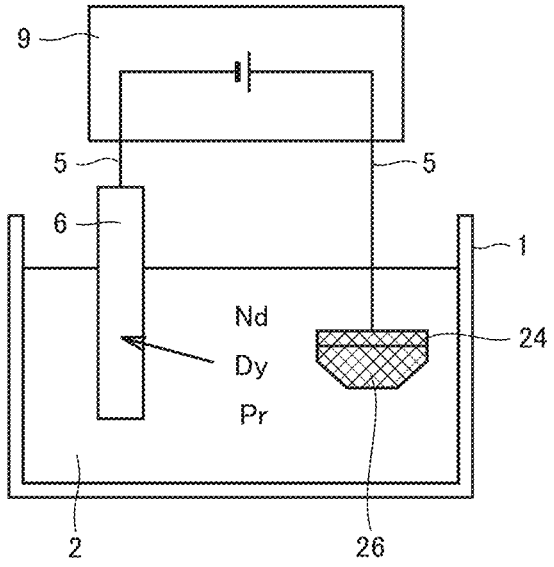
FIG. 11 is a schematic cross-sectional view for illustrating a modification of another embodiment of the element recovery method according to the present invention.

In addition, the above-described steps (S21 to S32) may be carried out by the apparatus configuration as described below. Specifically, the above-described step (S31) may be performed by the apparatus configuration as shown in FIG. 11. Specifically, in place of object to be processed 3 in the apparatus configuration in FIG. 8, basket 24 holding material 26 alloyed in the step shown in FIG. 7 is immersed in molten salt 2. Then, as shown in FIG. 11, this basket 24 and control unit 9 are electrically connected through conductive wire 5. Then, the electric potentials in material 26 alloyed in the step shown in FIG. 7 and held in basket 24 and electrode 6 are controlled to be adjusted at prescribed electric potentials. Consequently, Dy dissolved in molten salt 2 deposits as $DyNi_2$ on the surface of electrode 6. In addition, Dy can be recovered as a simple substance from $DyNi_2$ deposited on the surface of electrode 6 through the step similar to the step (S34) in FIG. 6.

Figure 12:
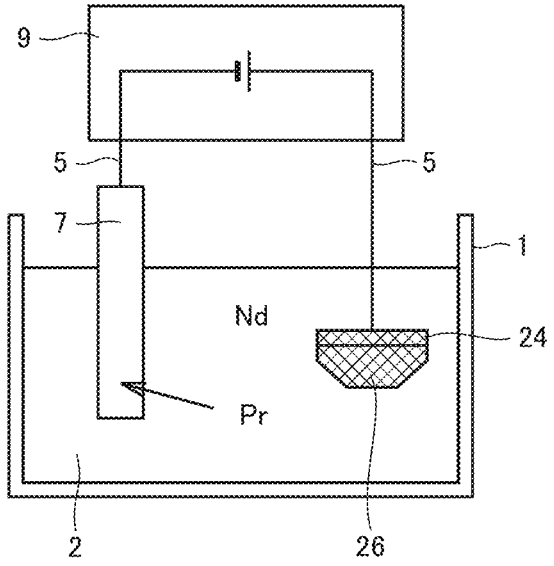
FIG. 12 is a schematic cross-sectional view for illustrating a modification of another embodiment of the element recovery method according to the present invention.

Then, as the step (S32) described above, the process may be carried out in the apparatus configuration as shown in FIG. 12. Specifically, in place of electrode 6 shown in FIG. 11, electrode 7 made of carbon is arranged so as to be immersed in molten salt 2 such that electrode 7 is located to face basket 24, as shown in FIG. 12. Then, electrode 7 and control unit 9 are electrically connected through conductive wire 5. Then, the electric potentials in alloy 26 held in basket 24 and electrode 7 are controlled to be adjusted at prescribed values. Consequently, Pr dissolved in molten salt 2 deposits on the surface of electrode 7.

Figure 13:
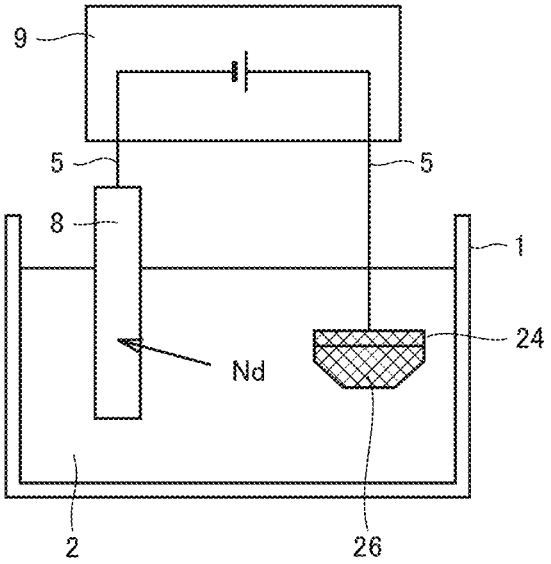
FIG. 13 is a schematic cross-sectional view for illustrating a modification of another embodiment of the element recovery method according to the present invention.

Then, as the step (S33) described above, the process may be carried out in the apparatus configuration as shown in FIG. 13. Specifically, as shown in FIG. 13, in place of electrode 7 in FIG. 12, electrode 8 made of carbon is arranged so as to be immersed in molten salt 2 such that electrode 8 is located to face basket 24. Then, electrode 8 and control unit 9 are electrically connected through conductive wire 5. Control unit 9 controls the electric potentials in alloy 26 disposed in basket 24 and electrode 8 so as to be adjusted at prescribed values. Consequently, Nd deposits on the surface of electrode 8.

According to the method as describe above, rare earth elements can be sequentially and separately recovered. Also, as compared with the conventional wet separation method, the method as described above can simplify the apparatus configuration and also can shorten the processing time. Accordingly, the cost of recovering an element such as a rare earth element can be reduced. Furthermore, by appropriately setting the electric potential in an electrode, a rare earth element can be caused to deposit as a simple substance on the surface of the electrode, so that a high-purity rare earth element can be recovered.

Characteristic configurations of the present invention will be hereinafter described though there may be some portions partially overlapping with the above-described embodiments.

The element recovery method according to the present invention includes the step (S10, S20, S21, steps shown in FIGS. 7 and 8) of preparing molten salt containing a rare earth element; and the step (S30, S31 to S33) of controlling electric potentials in a pair of electrode members (electrode 6 and object 3 in FIG. 8, electrodes 7 and 27 in FIG. 9, electrodes 8 and 27 in FIG. 10, electrode 6 and alloy 26 in FIG. 11, electrode 7 and alloy 26 in FIG. 12, and electrode 8 and alloy 26 in FIG. 13) to be set at prescribed values while keeping the pair of electrode members in contact with molten salt 2, thereby depositing a rare earth element existing in molten salt 2 on one of the pair of electrode members (electrode 6 in FIG. 8, electrode 7 in FIG. 9, electrode 8 in FIG. 10, electrode 6 in FIG. 11, electrode 7 in FIG. 12, and electrode 8 in FIG. 13).

In this way, as compared with the conventional wet separation method and the like, it becomes possible to directly recover an element from molten salt 2 in which an element such as a rare earth element to be recovered is dissolved, so that the steps in the recovery method can be simplified and reduced in cost.

According to the above-described element recovery method, in the depositing step (S30 and S31), as shown in FIG. 8, a rare earth element (for example, Dy) may be deposited by being alloyed with a material (for example, Ni used as a material of electrode 6 that is a cathode) forming an electrode member. In this case, the rare earth element can be reliably recovered by being alloyed with an electrode material.

According to the above-described element recovery method, in the depositing step (S30, S31 to S33), the values of the electric potentials in a pair of electrode members (electrodes 7 and 27 in FIG. 9, electrodes 8 and 27 in FIG. 10, electrode 6 and alloy 26 in FIG. 11, electrode 7 and alloy 26 in FIG. 12, electrode 8 and alloy 26 in FIG. 13) may be set so as to cause a rare earth element to deposit. In this case, a rare earth element can be reliably deposited on the surface of one of the electrodes for deposition.

According to the above-described element recovery method, in the step of preparing molten salt (S20, S21, steps shown in FIGS. 7, and 8), molten salt 2 may contain two types or more of rare earth elements. In the depositing step (S30, S31 to S33), the electric potentials in a pair of electrode members (electrode 6 and object 3 in FIG. 8, electrodes 7 and 27 in FIG. 9, electrodes 8 and 27 in FIG. 10, electrode 6 and alloy 26 in FIG. 11, electrode 7 and alloy 26 in FIG. 12, and electrode 8 and alloy 26 in FIG. 13) in contact with molten salt 2 may be controlled so as to separate and recover different types of rare earth elements. In this case, a prescribed rare earth element can be selectively recovered by controlling the electric potentials in the electrodes.

In the above-described element recovery method, the rare earth element contained in molten salt 2 may be chemically eluted from object to be processed 3 containing the rare earth element into molten salt 2. Furthermore, in the above-described element recovery method, the rare earth element contained in molten salt 2 may be electrochemically eluted into molten salt 2 under control of the electric potential in object to be processed 3 containing the rare earth element, as having been described in the step (S21). In this way, when eluting a rare earth element into molten salt 2, an optional method can be used in accordance with the rare earth element to be recovered.

According to the above-described element recovery method, the step of preparing molten salt may include the step (S10, S11) of preparing object to be processed 3 that is conductive and contains a rare earth element; and the step (S20, S21, steps shown in FIGS. 7 and 8) of eluting an element containing the rare earth element into the molten salt. In the step of eluting the rare earth element into the molten salt, the electric potentials in object to be processed 3 and the electrode member (electrodes 6 to 8 in FIG. 4, and electrode material 25 in FIG. 7) may be controlled to be set at prescribed values while keeping object to be processed 3 and the electrode member (electrodes 6 to 8 in FIG. 4, and electrode material 25 in FIG. 7) in contact with molten salt 2, thereby eluting the element containing the rare earth element in accordance with the electric potentials from object to be processed 3 into molten salt 2. In this case, by controlling the values of the electric potentials in object to be processed 3 and the electrode member, the element containing a rare earth element can be selectively eluted from object to be processed 3 into molten salt 2.

The element recovery method according to the present invention includes the step (S10, S11) of preparing object to be processed 3 that is conductive and contains a rare earth element; and the step (S20, S21, steps shown in FIGS. 7 and 8) of controlling electric potentials in object to be processed 3 and the electrode member (electrodes 6 to 8 in FIG. 4, and electrode material 25 in FIG. 7) so as to be set at prescribed values while keeping object to be processed 3 and the electrode member (electrodes 6 to 8 in FIG. 4, electrode material 25 in FIG. 7) in contact with molten salt 2, thereby eluting an element containing a rare earth element in accordance with the electric potentials from object to be processed 3 into molten salt 2.

In this way, by controlling the values of the electric potentials in object to be processed 3 and the electrode member, the element containing a rare earth element can be selectively eluted from object to be processed 3 into molten salt 2. Accordingly, as compared with the case where processes such as dissolution and extraction using acid and the like are repeated as in the conventional wet processing, the recovery step can be simplified, and a specific element can be selectively separated and recovered. Therefore, the recovery step can be improved in efficiency and reduced in cost.

According to the above-described element recovery method, in the elution step (S20, S21, steps shown in FIGS. 7 and 8), the values of the electric potentials may be set so as to elute the rare earth element into molten salt 2. In this case, the rare earth element can be selectively separated and recovered from object to be processed 3.

In the above-described element recovery method, the elution step (S20, S21, steps shown in FIGS. 7, and 8) may be performed several times in a state where values of the electric potentials are set at different setting values, as shown in FIGS. 7 and 8. In this case, by changing the values of the electric potentials, a plurality of types of rare earth elements can be efficiently eluted into molten salt 2 and recovered.

In the above-described element recovery method, object to be processed 3 may be a rare-earth magnet. The rare-earth magnet, which is made of main components including a rare earth element and iron, is used in one of main industrial applications of the rare earth element, and the production volume of this rare-earth magnet is expected to increase also in the future. Accordingly, also for the purpose of effectively utilizing resources, it is particularly effective to apply the present invention to recovery of a rare earth element from the rare-earth magnet.

In the above-described element recovery method, object to be processed 3 may be a metal waste material containing a rare earth element. In this case, the element containing a rare earth element can be recovered also from the metal waste material, thereby allowing effective utilization of resources.

The element recovery method according to the present invention includes the step (S10, S11) of preparing object to be processed 3 that is conductive and contains a rare earth element; and the step (S31, steps shown in FIG. 8) of controlling electric potentials in object to be processed 3 and the electrode member (electrodes 6 to 8 in FIG. 4, and electrode 6 in FIG. 8) to be set at prescribed values while keeping object to be processed 3 and the electrode member in contact with molten salt 2, thereby eluting an element containing the rare earth element in accordance with the values of the electric potentials from object to be processed 3 into molten salt 2, and causing the element to deposit on the electrode member.

In this way, the element contained in object to be processed 3 can be deposited on the surface of the electrode member (electrodes 6 to 8 in FIG. 4, electrode 6 in FIG. 8), and thereby readily recovered.

According to the above-described element recovery method, in the depositing step (S31, steps shown in FIG. 8), the values of the electric potentials may be set so as to cause a rare earth element to deposit on the electrode member. In this case, the rare earth element can be selectively recovered.

In the above-described element recovery method, chloride-based molten salt or fluoride-based molten salt may be used as molten salt 2. Furthermore, in the above-described element recovery method, molten salt 2 obtained by combining chloride-based molten salt and fluoride-based molten salt may be used as molten salt 2. In this case, since molten salt 2 of high solubility such as a rare earth element that is to be recovered is used, the efficiency of recovering this rare earth element and the like can be raised.

In the above-described element recovery method, object to be processed 3 may contain a transition metal. In this case, since the rare earth element is often used as a compound with a transition metal, it becomes possible to widen the range of the materials that can be processed as object to be processed 3.

The element recovery apparatus according to the present invention includes a container 1 containing molten salt 2; an electrode for recovery (electrodes 6 to 8 in FIG. 4; a holding electrode (a basket 4 in FIG. 4); and a control unit 9. The electrode for recovery is immersed in molten salt 2 contained in container 1. The holding electrode is immersed in molten salt 2 contained in container 1, and object to be processed 3 that is conductive and contains a rare earth element is held in this holding electrode. Molten salt 2 can circulate between inside and outside of the holding electrode. Control unit 9 controls the electric potentials in the electrode for recovery and the holding electrode. Control unit 9 can change the electric potentials. Furthermore, control unit 9 may be able to control a plurality of values of the electric potentials so as to be maintained in the electrode for recovery and the holding electrode in prescribed order for a prescribed time period.

In this case, by setting the values of the electric potentials such that a rare earth element is eluted into molten salt 2 from object to be processed 3 held in the holding electrode while the rare earth element deposits on the surface of the electrode for recovery, the rare earth element can be selectively recovered for each type of element. Furthermore, the electrode for recovery may include a plurality of electrode members (electrodes 6 to 8) connected to control unit 9 and having electric potentials in accordance with the types of the rare earth elements that are controlled by this control unit. In this case, as to a plurality of electrode members (electrodes 6 to 8), by sequentially switching among these electrode members controlled at prescribed values of the electric potentials, a different element (a rare earth element) can be deposited on the surface of each of the electrode members (electrodes 6 to 8), and thereby recovered. In addition, as molten salt 2 used in the element recovery method and the element recovery apparatus described above, chloride-based molten salt may be KCl, NaCl, $CaCl_2$, LiCl, RbCl, CsCl, $SrCl_2$, $BaCl_2$, $MgCl_2$, and the like, for example. Furthermore, as molten salt 2, fluoride-based molten salt may be LiF, NaF, KF, RbF, CsF, $MgF_2$, $CaF_2$, $SrF_2$, and $BaF_2$, for example. In the case where a rare earth element is recovered, it is preferable to use chloride-based molten salt 2 in light of the recovering efficiency. Furthermore, it is preferable to use KCl, NaCl and $CaCl_2$ among chloride-based molten salt since these can be readily available at low cost.

Furthermore, in the above-described step (S20), step (S21) and the like of dissolving a rare earth element and the like in molten salt 2, an electrode (cathode) used to be paired with object to be processed 3 is preferably an electrode made for example of carbon or a material (Al, Zn, Ga, Cd, In, Sn, Sb, Pb, Bi) forming an alloy with an alkali metal, as shown in FIG. 7.

Furthermore, in the above-described step (S30) and steps (S31 to S34) of causing a rare earth element and the like dissolved in molten salt 2 to deposit on the surfaces of electrodes 6 to 8 and the like, any conductor can be used as an electrode (cathode) on the side where a rare earth element is caused to deposit. However, in the case where an element (a rare earth element) to be recovered is cause to deposit as an alloy and the case where a solid conductor is used as an electrode (cathode) material, it is preferable to use Ni, Al, Si, Mn, Fe, Co, Cu, Ge and the like as an electrode material, for example. Furthermore, in the case where a liquid conductor is used as an electrode (cathode) material, it is preferable to use Zn, Ga, Cd, In, Sn, Sb, Pb, Bi, and the like as an electrode material, for example. Alternatively, in the case where an element (a rare earth element) to be recovered is caused to deposit as a simple substance, it is preferable to use C, Mo W, Ti, V, Cr, Zr, Nb, Ta, and the like as an electrode (cathode) material.

As an anode used when an element including a rare earth element as described above is caused to deposit, it is preferable to use an electrode made, for example, of carbon or a material (Al, Zn, Ga, Cd, In, Sn, Sb, Pb, Bi) forming an alloy with an alkali metal.

Furthermore, in the above-described step (S30) and steps (S31 to S34), the deposition potential of the element (more specifically, a rare earth element) to be deposited (to be recovered) that is used for determining the setting electric potential in the electrode is calculated by electrochemical calculation, as described below, specifically using the Nernst equation.

For example, the electric potential (deposition potential: $E_{Pr}$) for causing Pr to deposit as a simple substance from trivalent Pr ions on the surface of the electrode can be determined based on the following equation.

$$E_{Pr}=E^{0}_{Pr}+RT/3F\cdot In(a_{Pr(III)}/a_{Pr(0)}) \quad \text{Equation (1)}$$

In the above-described equation (1), $E^{0}_{Pr}$ indicates a standard potential; R indicates a gas constant; T indicates an absolute temperature; F indicates Faraday constant; $a_{Pr(III)}$ indicates the activity of a trivalent Pr ion; $a_{Pr(0)}$ indicates the activity of a Pr simple substance. Rewriting of the above-described equation (1) in consideration of an activity coefficient $\gamma_{Pr(III)}$ results in $a_{Pr(0)}=1$, which leads to the following equation.

$$\begin{aligned} E_{Pr} &= E^{0}_{Pr} + RT/3F\cdot \text{In } a_{Pr(III)} \\ &= E^{0}_{Pr} + RT/3F\cdot \text{In}(\gamma_{Pr(III)}\cdot C_{Pr(III)}) \end{aligned} \quad \text{Equation (2)}$$

$$E_{Pr} = E^{0'}_{Pr} + RT/3F\cdot \text{In } C_{Pr(III)} \quad \text{Equation (3)}$$

In the above-described equation (3), $C_{Pr(III)}$ indicates the concentration of trivalent Pr ions; and $E^{0'}_{Pr}$ indicates formal electrode potential (in this case, equal to $E^{0}_{Pr}+RT/3F\cdot \text{In}\gamma_{Pr(III)}$).

Furthermore, the electric potential in the case where a PrNi alloy is cause to deposit on the surface of the electrode (deposition potential: $E_{Pr\text{-}Ni}$) can be similarly determined based on the following equation.

$$E_{Pr\text{-}Ni}=E^{0'}_{Pr\text{-}Ni}+RT/3F\cdot InC_{Pr(III)} \quad \text{Equation (4)}$$

In the above-described equation (4), $E^{0'}_{Pr\text{-}Ni}$ indicates a formal electrode potential (in this case, equal to $E^{0}_{Pr\text{-}Ni}+RT/3F\cdot \text{In}\gamma_{Pr(III)}$).

As to the deposit of the element to be recovered, the deposition potential for each type of the molten salt to be used can be determined based on the above-described equations. In the actual recovering process, based on the value of the deposition potential determined as described above, the deposit is selected that is capable of ensuring the distance of electric potentials at which sufficiently selective deposition can be achieved, and also, the order of depositing the elements is determined. Also, the electric potential controlled when actually recovering an element is influenced by the sizes of electrodes 6 to 8, the relative positional relationship between a pair of electrodes, and the like. Accordingly, it is preferable that, after experimentally determining the electric potential used as a reference, the value of the electric potential in the electrode is determined in the step of depositing each element in consideration of the value of the above-mentioned deposition potential and the order of depositing the elements.

EXAMPLES

The following experiments were conducted in order to confirm the effects of the present invention.

(Samples)

Figure 14:
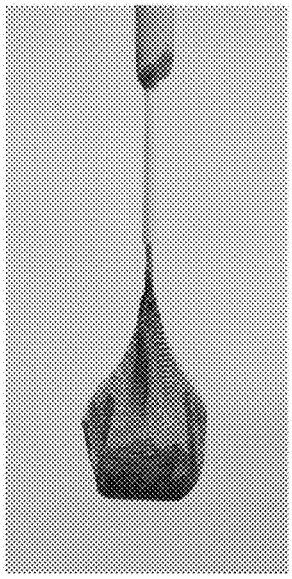
FIG. 14 is a photograph for illustrating an anode electrode used in an example of the present invention.

A neodymium-based magnet (Fe—B—Nd—Dy) was prepared as a sample used as an object to be processed. Specifically, the neodymium-based magnet was first pulverized. The grain size of the pulverized sample was about 2 mm. Then, the pulverized sample (neodymium-based magnet) was wrapped in a net (50 mesh) made of molybdenum (Mo). Sample powder held within the basket-shaped net as shown in FIG. 14 was used as an anode electrode.

(Details of Experiment)

The molten salt having a eutectic composition of NaCl—KCl was prepared as molten salt. Specifically, salt having the above-described composition was heated at 700° C. and completely melted. Then, the above-described anode electrode and a cathode electrode were immersed in this molten salt. Glassy carbon was used as a material of the cathode electrode.

Elution Step:

In the state where the anode electrode and the cathode electrode were immersed in the molten salt in this way, the anode electrode was kept at a prescribed electric potential. Then, after a lapse of a prescribed time period, a sample was extracted from the molten salt, and subjected to composition analysis by ICP-AES.

Electrolysis Step:

After the above-described elution step, the cathode electrode made of Ni and the anode electrode made of glassy carbon were immersed in the molten salt, and the electric potential of the cathode electrode was kept at a prescribed electric potential. Specifically, the electric potential of the cathode electrode was kept at a value at which a Dy—Ni alloy was formed in the NaCl—KCl-based molten salt. Then, after a lapse of a prescribed time period, the surface state of the cathode electrode was observed.

(Results)

Figure 15:
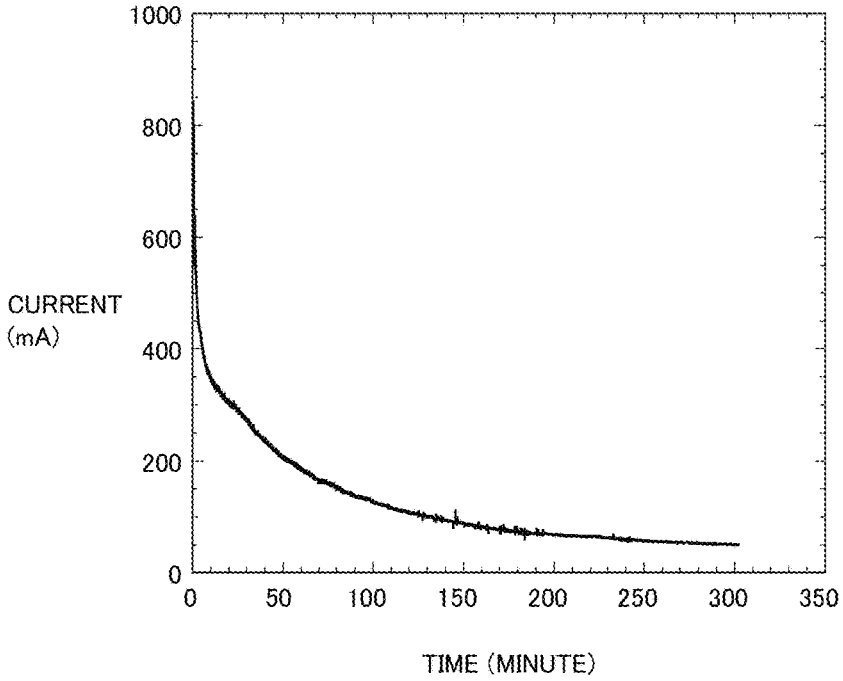
FIG. 15 is a graph showing the relation between an anode current value and time in the example of the present invention.

Elution Step:

The anode current observed in the elution step exhibited aging variation as shown in FIG. 15. In FIG. 15, the horizontal axis shows time (unit: minute) while the vertical axis shows a current value of the anode current (unit: mA). As shown in FIG. 15, the current value decreased as time passed. Furthermore, there was a tendency that the time rate of change about the current value was the highest at the start of measurement (at the start of energization), and then, gradually decreased.

Then, the sample extracted from the molten salt was subjected to composition analysis by ICP-AES, with the result that it was confirmed that Nd and Dy were dissolved in the molten salt.

Figure 16:
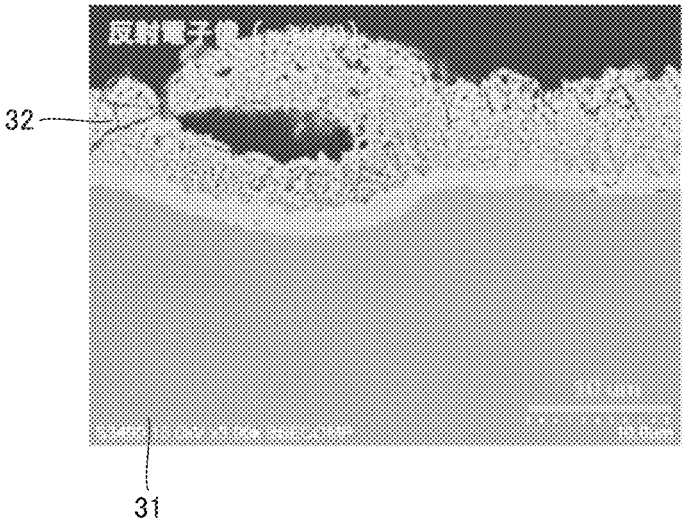
FIG. 16 is a scanning electron microscope photograph showing a surface portion of a cathode electrode used in the electrolysis step.
Figure 17:
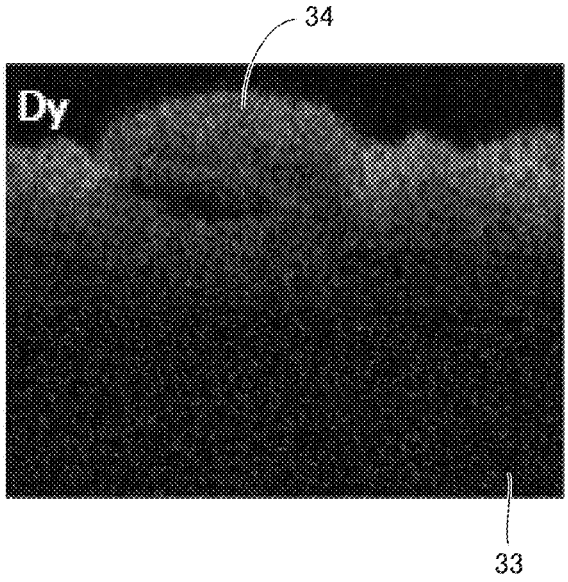
FIG. 17 is a scanning electron microscope photograph showing the distribution state of Dy in a region of the electron microscopic photograph shown in FIG. 16.

Electrolysis Step:

FIGS. 16 and 17 each show the result of observing the cross section of the surface layer of the cathode electrode with a scanning electron microscope (SEM). As shown in FIGS. 16 and 17, a Dy—Ni alloy 32 deposited on the surface of an electrode body portion 31 that is made of Ni forming a cathode electrode. It is considered that this Dy—Ni alloy 32 deposited on the surface of the cathode electrode by reaction of Dy existed in the molten salt with Ni forming the cathode electrode. In this way, Dy contained in the neodymium-based magnet can be separated and extracted in the form of a Dy—Ni alloy from the magnet.

In addition, FIG. 16 shows a reflected electron image obtained by the SEM, and FIG. 17 shows distribution of Dy atoms through X-ray analysis of the region shown in FIG. 16. As shown in FIG. 17, Dy is hardly detected in a region 33 corresponding to electrode body portion 31 while Dy is detected in a region 34 corresponding to Dy—Ni alloy 32.

It should be understood that the embodiments and examples disclosed herein are illustrative and non-restrictive in every respect. The scope of the present invention is defined by the terms of the claims, rather than the description above, and is intended to include any modifications within the scope and meaning equivalent to the terms of the claims.

INDUSTRIAL APPLICABILITY

The present invention is advantageously applied particularly to recovery of a rare earth element.

REFERENCE SIGNS LIST

1 container, 2 molten salt, 3 object to be processed, 4, 24 basket, 5 conductive wire, 6 to 8, 15, 27 electrode, 9 control unit, 10 heater, 11 $DyNi_2$ film, 12 Pr film, 13 Nd film, 16 Dy film, 25 electrode material, 26 alloy, 31 electrode body portion, 32 Dy—Ni alloy, 33, 34 region.

The invention claimed is:

1. An element recovery method comprising:

placing an object to be processed and an electrode member in contact with molten salt, the object to be processed being conductive and containing at least two rare earth elements, wherein the object to be processed is previously pulverized and is held in a basket, the basket being a member configured to wrap the object to be processed, and wherein one of the at least two of the rare earth elements has a first deposition potential and the other of the at least two of the rare earth elements has a second deposition potential, and the first deposition potential is higher than the second deposition potential;

eluting the at least two of the rare earth elements from the object to be processed held in the basket into the molten salt by controlling electric potentials in the object to be processed and the electrode member while keeping the object to be processed and the electrode member in contact with the molten salt, after the at least two of the rare earth elements are eluted from the object to be processed, depositing one of the rare earth elements on the electrode member by controlling an electrical potential of the electrode member so as to set the electrical potential of the electrode member at a first value lower than the first deposition potential and higher than the second deposition potential; and after the electrical potential of the electrode member is set at the first value, setting the electrical potential of the electrode member at a second value lower than the second deposition potential, wherein the deposition potentials for the at least two rare earth elements are different for each of the at least two rare earth elements and depend on the composition and temperature of the molten salt, and wherein during the controlling of the electric potentials in the object to be processed and the electrode member, the electric potentials in the object to be processed and the electrode member in contact with the molten salt are changed.

2. The element recovery method according to claim 1, wherein the object to be processed contains a d-block transition metal.

3. The element recovery method according to claim 1, wherein one of chloride-based molten salt and fluoride-based molten salt is used as the molten salt.

4. The element recovery method according to claim 1, wherein the molten salt is a combined molten salt of chloride-based molten salt and fluoride-based molten salt.

5. The element recovery method according to claim 1, wherein the electrode member includes two or more electrodes.

6. The element recovery method according to claim 5, further comprising:

setting the electric potential of one of the electrodes at the first value; and setting the electrical potential of the other of the electrodes at the second value.

7. The element recovery method according to claim 1, wherein the electrode member is a plate.

* * * * *